US008342956B2

(12) United States Patent
Anderson

(10) Patent No.: US 8,342,956 B2
(45) Date of Patent: Jan. 1, 2013

(54) PROGRESSIVE WAGERING GAME WITH FUNDING DISTRIBUTION FEATURE

(75) Inventor: Peter R. Anderson, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 996 days.

(21) Appl. No.: 11/919,733

(22) PCT Filed: May 30, 2006

(86) PCT No.: PCT/US2006/020979

§ 371 (c)(1),
(2), (4) Date: Jan. 21, 2009

(87) PCT Pub. No.: WO2006/130611

PCT Pub. Date: Dec. 7, 2006

(65) Prior Publication Data

US 2009/0305777 A1 Dec. 10, 2009

Related U.S. Application Data

(60) Provisional application No. 60/685,930, filed on May 31, 2005.

(51) Int. Cl.
*A63F 9/24* (2006.01)

(52) U.S. Cl. ..... 463/27; 463/20

(58) Field of Classification Search ..... None
See application file for complete search history.

(56) References Cited

U.S. PATENT DOCUMENTS

| | | | | |
|---|---|---|---|---|
| 4,624,459 | A | 11/1986 | Kaufman | 273/143 R |
| 4,837,728 | A | 6/1989 | Barrie et al. | 364/412 |
| 4,861,041 | A | 8/1989 | Jones et al. | 273/292 |
| 4,948,134 | A | 8/1990 | Suttle et al. | 273/85 |
| 5,116,055 | A | 5/1992 | Tracy | 273/138 A |
| 5,249,800 | A | 10/1993 | Hilgendorf et al. | 273/138 A |
| 5,275,400 | A | 1/1994 | Weingardt et al. | 463/12 |

(Continued)

FOREIGN PATENT DOCUMENTS

CA 2 334 546 8/2001

(Continued)

OTHER PUBLICATIONS

Article for "Easy Riches" by Sigma Game, Strictly Slots, 1 page (Aug. 2001).

(Continued)

*Primary Examiner* — Melba Bumgarner
*Assistant Examiner* — George Howarah
(74) *Attorney, Agent, or Firm* — Nixon Peabody LLP

(57) ABSTRACT

The present invention is a method and a gaming system for operating a progressive game that is accessible at a plurality of gaming machines. The progressive game has a plurality of progressive jackpots. The method and system involve collecting wager-input data at the plurality of gaming machines that corresponds to wager inputs made at the plurality of gaming machines, and crediting a portion of the wager inputs to a first group of the plurality of progressive jackpots in accordance with a first distribution set. In response to the wager-input data meeting a predetermined criteria, the method and system include crediting a portion of subsequent wager inputs to a second group of the plurality of progressive jackpots in accordance with a second distribution set. The first group directs funds to at least one progressive jackpot in an amount that is different from the second group.

34 Claims, 8 Drawing Sheets

DISTRIBUTION SETS FOR SEQUENCED FUNDING OF PROGRESSIVE JACKPOTS 312 314 316 310

| SET | CONTRIBUTION THRESHOLD | RED 1 | RED 2 | RED 3 | WHITE 1 | WHITE 2 | WHITE 3 | BLUE 1 | BLUE 2 | BLUE 3 | TOTAL |
|---|---|---|---|---|---|---|---|---|---|---|---|
| 1. | $10 | 25% | 25% | 25% | 25% | 0% | 0% | 0% | 0% | 0% | 100% |
| 2. | $10 | 0% | 0% | 50% | 50% | 0% | 0% | 0% | 0% | 0% | 100% |
| 3. | $10 | 75% | 0% | 0% | 0% | 0% | 0% | 0% | 0% | 25% | 100% |
| 4. | $10 | 0% | 0% | 0% | 0% | 0% | 25% | 25% | 25% | 25% | 100% |
| 5. | $10 | 0% | 0% | 25% | 25% | 25% | 25% | 0% | 0% | 0% | 100% |
| 6. | $10 | 0% | 75% | 0% | 0% | 0% | 0% | 25% | 0% | 0% | 100% |
| 7. | $10 | 0% | 0% | 0% | 0% | 75% | 0% | 25% | 0% | 0% | 100% |
| 8. | $10 | 0% | 0% | 0% | 0% | 0% | 50% | 0% | 0% | 50% | 100% |
| 9. | $10 | 0% | 0% | 0% | 0% | 0% | 0% | 25% | 75% | 0% | 100% |

U.S. PATENT DOCUMENTS

| | | | | |
|---|---|---|---|---|
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell, II | 273/85 CP |
| 5,417,430 | A | 5/1995 | Breeding | 273/292 |
| 5,524,888 | A | 6/1996 | Heidel | 463/22 |
| 5,544,892 | A | 8/1996 | Breeding | 273/292 |
| 5,564,700 | A | 10/1996 | Celona | 463/27 |
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,611,730 | A | 3/1997 | Weiss | 463/20 |
| 5,645,486 | A | 7/1997 | Nagao et al. | 463/27 |
| 5,647,592 | A | 7/1997 | Gerow | 463/139 |
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,839,956 | A | 11/1998 | Takemoto | 463/25 |
| 5,848,932 | A | 12/1998 | Adams | 463/20 |
| 5,851,147 | A | 12/1998 | Stupak | 463/13 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 6,003,013 | A | 12/1999 | Boushy et al. | 705/10 |
| 6,007,427 | A | 12/1999 | Wiener et al. | 463/17 |
| 6,012,982 | A | 1/2000 | Piechowiak et al. | 463/16 |
| 6,032,955 | A | 3/2000 | Luciano et al. | 273/138.1 |
| 6,047,963 | A | 4/2000 | Pierce et al. | 273/121 B |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,799 | A | 8/2000 | Stupak | 463/27 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | 463/20 |
| 6,168,523 | B1 | 1/2001 | Piechowiak et al. | 463/26 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,241,608 | B1 | 6/2001 | Torango | 463/27 |
| 6,254,483 | B1 | 7/2001 | Acres | 463/26 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | 463/26 |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,347,996 | B1 | 2/2002 | Gilmore et al. | 463/17 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,416,409 | B1 | 7/2002 | Jordan | 463/27 |
| 6,431,983 | B2 | 8/2002 | Acres | 463/25 |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,577,733 | B1 | 6/2003 | Charrin | 380/251 |
| 6,589,115 | B2 | 7/2003 | Walker et al. | 463/25 |
| 6,592,458 | B1 | 7/2003 | Ho | 463/17 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,648,762 | B2 | 11/2003 | Walker et al. | 463/25 |
| 6,656,052 | B2 | 12/2003 | Abramopoulos et al. | 463/47 |
| 6,676,513 | B2 | 1/2004 | Gauselmann | 463/20 |
| 6,712,695 | B2 | 3/2004 | Mothwurf et al. | 463/25 |
| 6,733,390 | B2 | 5/2004 | Walker et al. | 463/23 |
| 6,776,715 | B2 | 8/2004 | Price | 463/27 |
| 6,887,154 | B1 | 5/2005 | Luciano, Jr. et al. | 463/26 |
| 7,004,466 | B2 | 2/2006 | Gauselmann | 463/138 |
| 7,036,012 | B2 | 4/2006 | Charrin | 713/169 |
| 7,056,215 | B1 | 6/2006 | Olive | 463/27 |
| 7,481,430 | B1 * | 1/2009 | Jackson et al. | 273/138.1 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2003/0014370 | A1 | 1/2003 | Charrin | 705/65 |
| 2003/0027618 | A1 | 2/2003 | Byrne | 463/16 |
| 2003/0027625 | A1 | 2/2003 | Rowe | 463/20 |
| 2003/0036430 | A1 | 2/2003 | Cannon | 463/42 |
| 2003/0045337 | A1 | 3/2003 | Byrne | 463/16 |
| 2003/0045351 | A1 * | 3/2003 | Gauselmann | 463/29 |
| 2003/0050106 | A1 | 3/2003 | Lyfoung | 463/13 |
| 2003/0060266 | A1 | 3/2003 | Baerlocher | 463/20 |
| 2003/0064776 | A1 | 4/2003 | Byrne | 463/16 |
| 2003/0109306 | A1 | 6/2003 | Karmarkar | 463/40 |
| 2003/0148807 | A1 | 8/2003 | Acres | 463/40 |
| 2003/0148808 | A1 | 8/2003 | Price | 463/27 |
| 2003/0181231 | A1 | 9/2003 | Vancura et al. | 463/9 |
| 2003/0186733 | A1 | 10/2003 | Wolf et al. | 463/16 |
| 2003/0211884 | A1 | 11/2003 | Gauselmann | 463/20 |
| 2003/0216166 | A1 | 11/2003 | Baerlocher et al. | 463/20 |
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0009811 | A1 | 1/2004 | Torango | 463/25 |
| 2004/0023716 | A1 | 2/2004 | Gauselmann | 463/23 |
| 2004/0038741 | A1 | 2/2004 | Gauselmann | 463/42 |
| 2004/0048644 | A1 | 3/2004 | Gerrard et al. | 463/16 |
| 2004/0092304 | A1 | 5/2004 | George | 463/29 |
| 2005/0003880 | A1 | 1/2005 | Englman | 463/16 |
| 2005/0055113 | A1 | 3/2005 | Gauselmann | 700/91 |
| 2005/0059467 | A1 | 3/2005 | Saffari et al. | 463/19 |
| 2005/0059472 | A1 * | 3/2005 | Joshi et al. | 463/20 |
| 2005/0064930 | A1 | 3/2005 | Jubinville et al. | 463/17 |
| 2005/0096130 | A1 | 5/2005 | Mullins | 463/27 |
| 2005/0137010 | A1 | 6/2005 | Enzminger et al. | 463/25 |
| 2005/0192088 | A1 | 9/2005 | Hartman et al. | 463/27 |
| 2005/0215313 | A1 | 9/2005 | O'Halloran | 463/26 |
| 2006/0003829 | A1 | 1/2006 | Thomas | 463/20 |
| 2006/0019737 | A1 | 1/2006 | Yang | 463/19 |
| 2006/0025195 | A1 | 2/2006 | Pennington et al. | 463/16 |
| 2006/0025210 | A1 | 2/2006 | Johnson | 463/25 |
| 2006/0030403 | A1 | 2/2006 | Lafky et al. | 463/27 |
| 2006/0052159 | A1 | 3/2006 | Cahill et al. | 463/27 |
| 2006/0073877 | A1 | 4/2006 | Rodgers et al. | 463/20 |
| 2006/0073889 | A1 | 4/2006 | Edidin et al. | 463/27 |
| 2006/0116201 | A1 | 6/2006 | Gauselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0189380 | A1 * | 8/2006 | Schultz et al. | 463/20 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |

| | | | | |
|---|---|---|---|---|
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |
| 2009/0131149 | A1* | 5/2009 | Jackson et al. | 463/20 |
| 2009/0298574 | A1* | 12/2009 | Gauselmann | 463/20 |
| 2010/0304830 | A1* | 12/2010 | Englman et al. | 463/17 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | A | 8/1999 |
| WO | WO 99/03078 | A1 | 1/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |

OTHER PUBLICATIONS

Article for "Millioniser" by Glenn Haussman, Strictly Slots, pp. 50-53 (Mar. 2004).

Product Sheet for "Big Games Safari," IGT, 24 pages (2000).

"New '97 Games," International Gaming & Wagering Business, 24 pages (Mar. 1997).

International Search Report—PCT/US06/20979 dated Nov. 13, 2006 (2 pages).

Written Opinion corresponding to International Patent Application Serial No. PCT/US2006/020979, United States Patent Office; dated Jan. 29, 2007; 3 pages.

International Preliminary Report on Patentability corresponding to International Patent Application Serial PCT/ US2006/020979, United States Patent Office; dated Mar. 10, 2008; 5 pages.

* cited by examiner 112 114 110

DISTRIBUTION SETS FOR SEQUENCED FUNDING OF PROGRESSIVE JACKPOTS 116

| SET | CONTRIBUTION THRESHOLD | RED 1 | RED 2 | RED 3 | WHITE 1 | WHITE 2 | WHITE 3 | BLUE 1 | BLUE 2 | BLUE 3 | TOTAL |
|---|---|---|---|---|---|---|---|---|---|---|---|
| 1. | $5 | 25% | 25% | 25% | 25% | 0% | 0% | 0% | 0% | 0% | 100% |
| 2. | $10 | 0% | 50% | 0% | 50% | 0% | 0% | 0% | 0% | 0% | 100% |
| 3. | $5 | 100% | 0% | 0% | 0% | 0% | 0% | 0% | 0% | 0% | 100% |
| 4. | $15 | 0% | 0% | 0% | 0% | 0% | 25% | 25% | 25% | 25% | 100% |
| 5. | $25 | 0% | 0% | 25% | 25% | 25% | 25% | 0% | 0% | 0% | 100% |

*Fig. 4*

212 214 210

DISTRIBUTION SETS FOR SEQUENCED FUNDING OF PROGRESSIVE JACKPOTS 216

| SET | CONTRIBUTION THRESHOLD | RED 1 | RED 2 | RED 3 | WHITE 1 | WHITE 2 | WHITE 3 | BLUE 1 | BLUE 2 | BLUE 3 | TOTAL |
|---|---|---|---|---|---|---|---|---|---|---|---|
| 1. | $0.20 | 25% | 25% | 25% | 25% | 0% | 0% | 0% | 0% | 0% | 100% |
| 2. | $0.15 | 0% | 50% | 0% | 50% | 0% | 0% | 0% | 0% | 0% | 100% |
| 3. | $0.05 | 100% | 0% | 0% | 0% | 0% | 0% | 0% | 0% | 0% | 100% |
| 4. | $0.15 | 0% | 0% | 0% | 0% | 0% | 25% | 25% | 25% | 25% | 100% |
| 5. | $0.25 | 0% | 0% | 25% | 25% | 25% | 25% | 0% | 0% | 0% | 100% |
| | | | | | ⋮ | | | | | | |
| n. | $0.10 | 0% | 0% | 25% | 25% | 25% | 25% | 0% | 0% | 0% | 100% |

*Fig. 5*

DISTRIBUTION SETS FOR SEQUENCED FUNDING OF PROGRESSIVE JACKPOTS 312 314 316 310

| SET | CONTRIBUTION THRESHOLD | RED 1 | RED 2 | RED 3 | WHITE 1 | WHITE 2 | WHITE 3 | BLUE 1 | BLUE 2 | BLUE 3 | TOTAL |
|---|---|---|---|---|---|---|---|---|---|---|---|
| 1. | $10 | 25% | 25% | 25% | 25% | 0% | 0% | 0% | 0% | 0% | 100% |
| 2. | $10 | 0% | 0% | 50% | 50% | 0% | 0% | 0% | 0% | 0% | 100% |
| 3. | $10 | 75% | 0% | 0% | 0% | 0% | 0% | 0% | 0% | 25% | 100% |
| 4. | $10 | 0% | 0% | 0% | 0% | 0% | 25% | 25% | 25% | 25% | 100% |
| 5. | $10 | 0% | 0% | 25% | 25% | 25% | 25% | 0% | 0% | 0% | 100% |
| 6. | $10 | 0% | 75% | 0% | 0% | 0% | 0% | 25% | 0% | 0% | 100% |
| 7. | $10 | 0% | 0% | 0% | 0% | 75% | 0% | 25% | 0% | 0% | 100% |
| 8. | $10 | 0% | 0% | 0% | 0% | 0% | 50% | 0% | 0% | 50% | 100% |
| 9. | $10 | 0% | 0% | 0% | 0% | 0% | 0% | 25% | 75% | 0% | 100% |

*Fig. 6*

DISTRIBUTION SETS FOR SEQUENCED FUNDING OF PROGRESSIVE JACKPOTS 412 414 416 410

| SET | CONTRIBUTION THRESHOLD | RED 1 | RED 2 | RED 3 | WHITE 1 | WHITE 2 | WHITE 3 | BLUE 1 | BLUE 2 | BLUE 3 | TOTAL |
|---|---|---|---|---|---|---|---|---|---|---|---|
| 1. | $10 | 25% | 25% | 25% | 25% | 0% | 0% | 0% | 0% | 0% | 100% |
| 2. | $20 | 0% | 0% | 50% | 50% | 0% | 0% | 0% | 0% | 0% | 100% |
| 3. | $10 | 75% | 0% | 0% | 0% | 0% | 0% | 0% | 0% | 25% | 100% |
| 4. | $10 | 0% | 0% | 0% | 0% | 0% | 25% | 25% | 25% | 25% | 100% |
| 5. | $10 | 0% | 0% | 25% | 25% | 25% | 25% | 0% | 0% | 0% | 100% |
| 6. | $10 | 0% | 75% | 0% | 0% | 0% | 0% | 25% | 0% | 0% | 100% |
| 7. | $10 | 0% | 0% | 0% | 0% | 75% | 0% | 25% | 0% | 0% | 100% |
| 8. | $20 | 0% | 0% | 0% | 0% | 0% | 50% | 0% | 0% | 50% | 100% |
| 9. | $10 | 0% | 0% | 0% | 0% | 0% | 0% | 25% | 75% | 0% | 100% |

*Fig. 7*

DISTRIBUTION SETS FOR RANDOM FUNDING OF PROGRESSIVE JACKPOTS 512 514 516 510

| SET | CONTRIBUTION THRESHOLD | RED 1 | RED 2 | RED 3 | WHITE 1 | WHITE 2 | WHITE 3 | BLUE 1 | BLUE 2 | BLUE 3 | TOTAL |
|---|---|---|---|---|---|---|---|---|---|---|---|
| 1. | X1 | 25% | 25% | 25% | 25% | 0% | 0% | 0% | 0% | 0% | 100% |
| 2. | X2 | 0% | 0% | 50% | 50% | 0% | 0% | 0% | 0% | 0% | 100% |
| 3. | X3 | 75% | 0% | 0% | 0% | 0% | 0% | 0% | 0% | 25% | 100% |
| 4. | X4 | 0% | 0% | 0% | 0% | 0% | 25% | 25% | 25% | 25% | 100% |
| 5. | X5 | 0% | 0% | 25% | 25% | 25% | 25% | 0% | 0% | 0% | 100% |
| 6. | X6 | 0% | 75% | 0% | 0% | 0% | 0% | 25% | 0% | 0% | 100% |
| 7. | X7 | 0% | 0% | 0% | 0% | 75% | 0% | 25% | 0% | 0% | 100% |
| 8. | X8 | 0% | 0% | 0% | 0% | 0% | 50% | 0% | 0% | 50% | 100% |
| 9. | X9 | 0% | 0% | 0% | 0% | 0% | 0% | 25% | 75% | 0% | 100% |

*Fig. 8*

612 614 616 610

DISTRIBUTION SETS FOR SEQUENCED FUNDING OF PROGRESSIVE JACKPOTS

| SET | COIN-IN THRESHOLD | RED 1 | RED 2 | RED 3 | WHITE 1 | WHITE 2 | WHITE 3 | BLUE 1 | BLUE 2 | BLUE 3 | TOTAL |
|---|---|---|---|---|---|---|---|---|---|---|---|
| 1. | $5 | 0.5% | 1.0% | 0% | 0% | 0% | 0% | 0% | 0% | 0% | 1.5% |
| 2. | $10 | 0% | 0% | 0% | 1.5% | 0% | 0% | 0% | 0% | 0% | 1.5% |
| 3. | $0.50 | 0% | 0% | 1.0% | 0% | 0% | 0.5% | 0% | 0% | 0% | 1.5% |
| 4. | $1.25 | 0% | 0% | 0% | 0% | 1.0% | 0% | 0.5% | 0% | 0% | 1.5% |
| ⋮ | | | | | | | | | | | |
| n. | $5 | 0% | 0% | 0% | 0% | 0% | 0% | 0% | 0.75% | 0.75% | 1.5% |

*Fig. 9*

712 714 716a 716 710

DISTRIBUTION SETS FOR SEQUENCED FUNDING OF PROGRESSIVE JACKPOTS

| Set | Coin In Threshold | WAP (TSP)/(LTD) | Red 1 (TSP)/(LTD) | Red 2 (TSP)/(LTD) | Red 3 (TSP)/(LTD) | White 1 (TSP)/(LTD) | White 2 (TSP)/(LTD) | White 3 (TSP)/(LTD) | Blue 1 (TSP)/(LTD) | Blue 2 (TSP)/(LTD) | Blue 3 (TSP)/(LTD) | Total (TSP)/(LTD) |
|---|---|---|---|---|---|---|---|---|---|---|---|---|
| 1 | $5 | (0%)/(.5%) | (0.5%)/(0%) | (1%)/(0%) | (0%)/(0%) | (0%)/(0%) | (0%)/(0%) | (0%)/(0%) | (0%)/(0%) | (0%)/(0%) | (0%)/(0%) | (1.5%)/(.5%) |
| 2 | $10 | (0%)/(.5%) | (0%)/(0%) | (0%)/(0%) | (0%)/(0%) | (1.5%)/(0%) | (0%)/(0%) | (0%)/(0%) | (0%)/(0%) | (0%)/(0%) | (0%)/(0%) | (1.5%)/(.5%) |
| 3 | $.50 | (0%)/(.5%) | (0%)/(0%) | (0%)/(0%) | (1%)/(0%) | (0%)/(0%) | (0%)/(0%) | (.5%)/(0%) | (0%)/(0%) | (0%)/(0%) | (0%)/(0%) | (1.5%)/(.5%) |
| 4 | $1.50 | (0%)/(.5%) | (0%)/(0%) | (0%)/(0%) | (0%)/(0%) | (0%)/(0%) | (1%)/(0%) | (0%)/(0%) | (.5%)/(0%) | (0%)/(0%) | (0%)/(0%) | (1.5%)/(.5%) |
| ⋮ | | | | | | | | | | | | |
| n | $5 | (0%)/(.5%) | (0%)/(0%) | (0%)/(0%) | (0%)/(0%) | (0%)/(0%) | (0%)/(0%) | (0%)/(0%) | (0%)/(0%) | (.75%)/(0%) | (.75%)/(0%) | (1.5%)/(.5%) |

*Fig. 10*

PROGRESSIVE WAGERING GAME WITH FUNDING DISTRIBUTION FEATURE

CROSS REFERENCE TO RELATED APPLICATIONS

This application is a U.S. national phase of International Application No. PCT/US2006/020979, filed May 30, 2006, which claims the benefit of priority of U.S. Provisional Patent Application No. 60/685,930, filed May 31, 2005, both of which are incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines and methods for playing wagering games, and more particularly, to a progressive wagering game that distributes funds to a plurality of progressive jackpots in accordance to a plurality of distribution sets that make the distribution appear random to the player.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

In many current wagering games, the progressive jackpots are funded in part by taking a percentage of the coin-in. After one of the progressive jackpots is won, that progressive jackpot will be reset to some basic level (e.g., $1,000 or $5,000). Every time a player makes a wager, a percentage of the wager is allocated to the progressive jackpots. This percentage is then divided in some predetermined way between all of the progressive jackpots. For example, if there are three progressive jackpots, a third of the percentage of the coin-in may be sent to each of the progressive jackpots. In other cases, one of the progressive jackpots may get one half of the percentage, another progressive jackpot may receive one third of the percentage, and the final progressive jackpot will get the remaining one sixth. This type of funding can become boring to the player because the player will see the amounts slowly creeping up, but never making any big leaps. Also, because it is predictable, many players will also find that boring.

Other attempts have been made to randomly award the progressive funding amounts to the various progressive jackpots. However, while this may increase the excitement for the player, one disadvantage is that the random-number generator that randomly assigns the funding amounts to the progressive jackpots must undergo various certifications to comply with local jurisdictional requirements.

Thus, there is a need to provide for a different type of funding method for progressive jackpots that provides player excitement but does not require the rigorous jurisdictional certifications that would be required if a random-number generator were used.

SUMMARY OF THE INVENTION

The present invention satisfies the needs mentioned above by using progressive-funding distribution sets that cause the funding to occur in a known manner, but has the appearance to the players of randomly allocating the funds to the various progressive jackpots.

One embodiment of the present invention is a method for playing a wagering game on a gaming machine at which players are eligible for a progressive game having a plurality of progressive jackpots. The method includes storing, in a memory device, a plurality of distribution sets for funding the plurality of progressive jackpots. Each distribution set defines a percentage of funds to be distributed to each of the plurality of progressive jackpots. In response to receiving wagers from the players, the method includes conducting wagering games in which the players are eligible for one or more of the plurality of progressive jackpots, and funding the plurality of progressive jackpots by a funding amount in accordance with the plurality of distribution sets.

The present invention can also be considered a gaming system for playing a progressive game have a plurality of progressive jackpots. The system includes a first gaming machine, a second gaming machine, and a controller. The first gaming machine has a first wagering game with a plurality of symbols that indicate a randomly selected outcome of the wagering game. The first gaming machine allows a player to be eligible for the plurality of progressive jackpots. The second gaming machine has a second wagering game with a plurality of symbols that indicate a randomly selected outcome of the second wagering game. The second gaming machine allows a player to be eligible for the plurality of progressive jackpots. The controller is coupled to the first and second gaming terminals and is operative to allocate progressive funds from at least the first and second gaming machines to the plurality of progressive jackpots in accordance with a plurality of distribution sets that are sequentially utilized. Each of the distribution sets defines a percentage of funds to be distributed to each of the plurality of progressive jackpots.

In another aspect, the present invention is a method of operating a progressive game that is accessible at a plurality of gaming machines. The progressive game has a plurality of progressive jackpots. The method comprises collecting wager-input data at the plurality of gaming machines that corresponds to wager inputs made at the plurality of gaming machines, and crediting a portion of the wager inputs to a first group of the plurality of progressive jackpots in accordance with a first distribution set. In response to the wager-input data meeting a predetermined criteria, the method includes crediting a portion of subsequent wager inputs to a second group of the plurality of progressive jackpots in accordance with a second distribution set. The first group directs funds to at least one progressive jackpot in an amount that is different from the second group. The predetermined criterion for moving from one distribution set to the next may be based on the aggregate coin-in received by the progressive controller or the aggregate amount distributed by a progressive controller. Once the aggregate value of coin-in has reached a predetermined threshold, the progressive controller begins to increment the progressive values based on the next distribution set. Typically, each distribution set has an associated fixed threshold indicating when to move to the next distribution set in the list of sets.

Alternatively, the present invention is a method for operating a progressive game having a plurality of progressive jackpots. The method comprises aggregating progressive-jackpot funds from a plurality of gaming machines at which the progressive game is accessible, and increasing the plurality of progressive jackpots with the progressive-jackpot funds in accordance with a plurality of distribution sets for funding the plurality of progressive jackpots. Each distribution set dictates an amount to be distributed to each of the plurality of progressive jackpots. The increasing function includes sequentially switching between or among the plurality of distribution sets.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

FIGS. 4-10 illustrate tables that include a plurality of distribution sets that are used for funding a plurality of progressive jackpots.

DESCRIPTION OF ILLUSTRATIVE EMBODIMENTS

Figure 1:
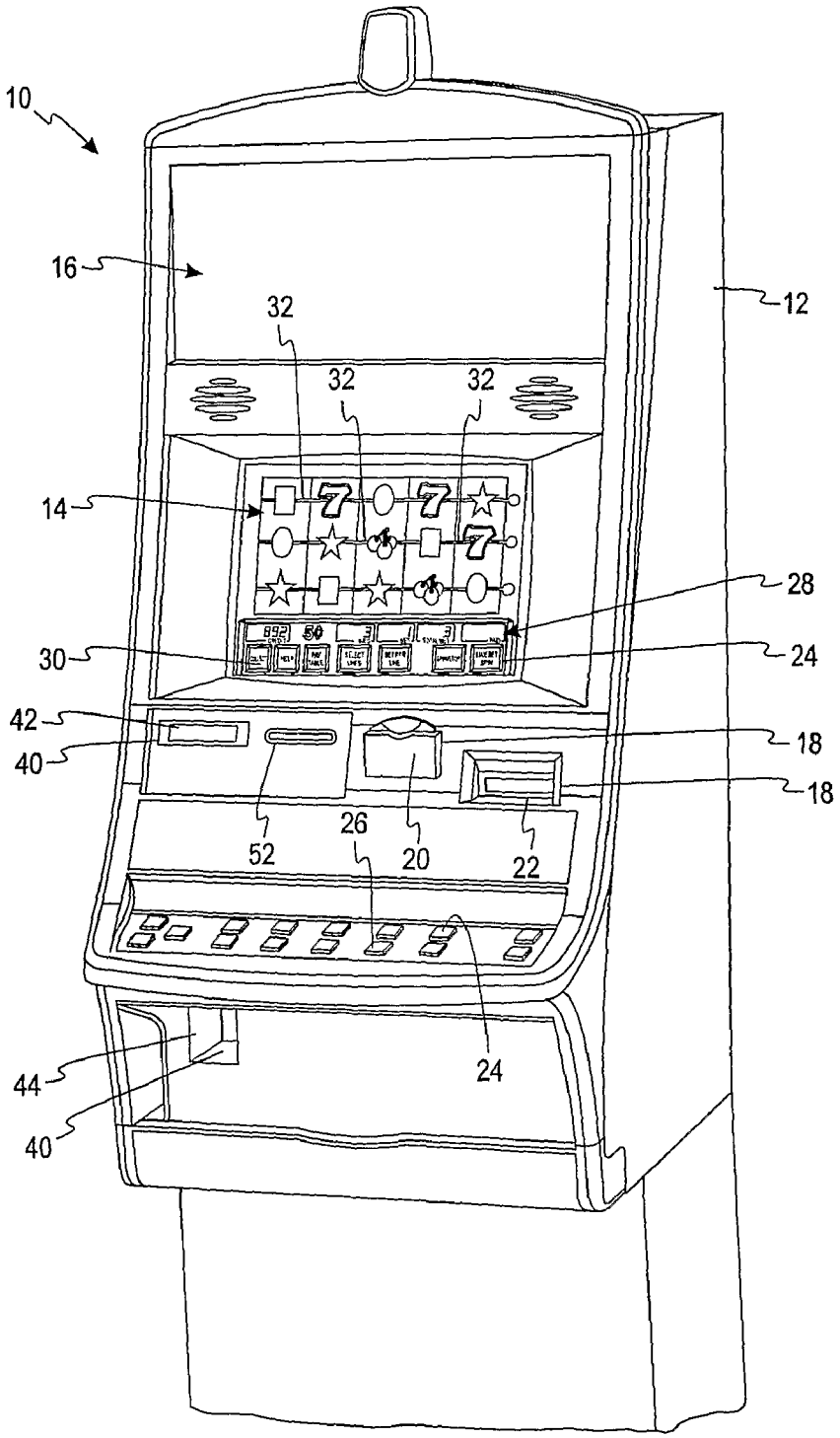
FIG. 1 is a perspective view of a gaming machine according to one embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaining machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual association to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
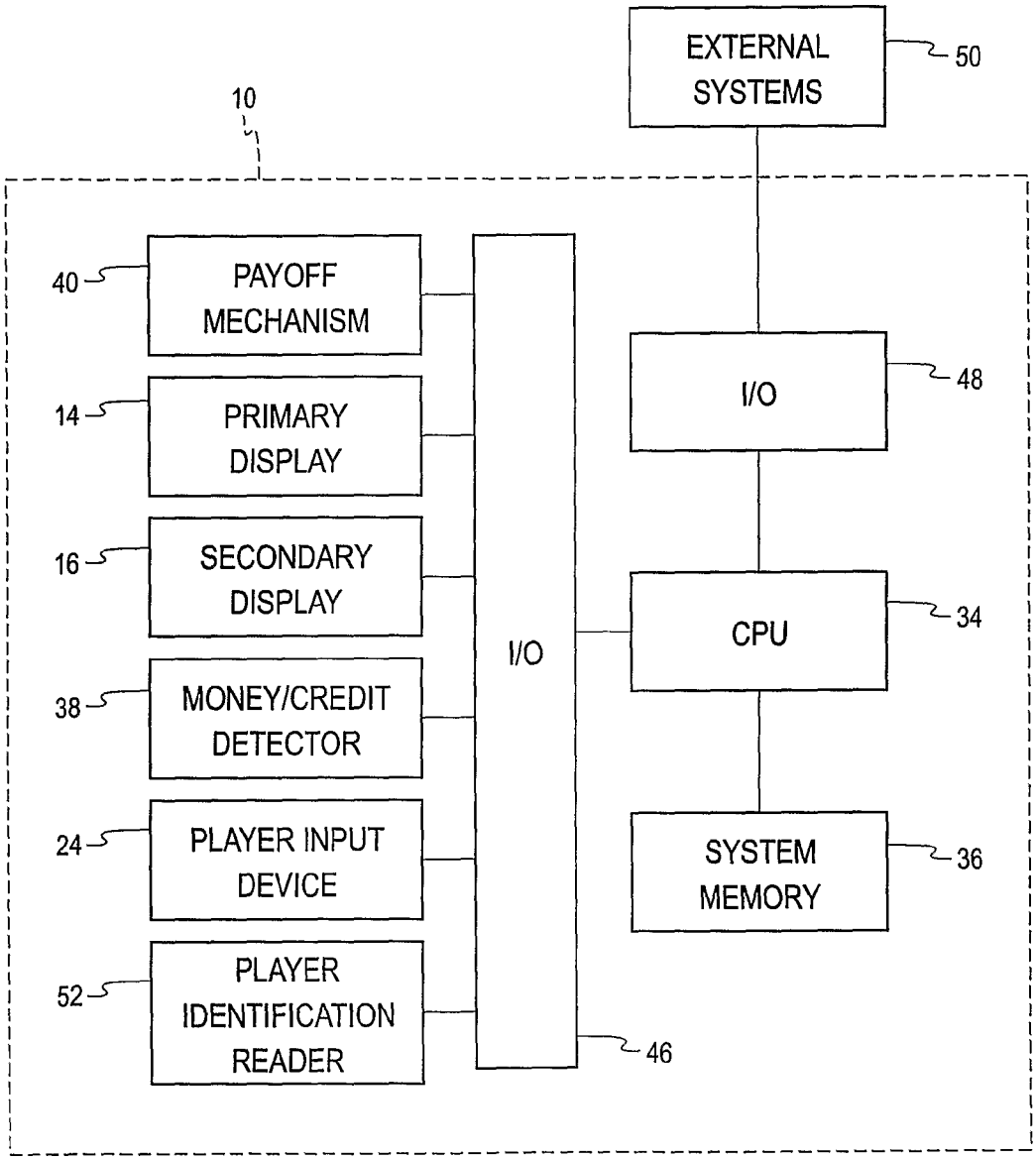
FIG. 2 is a block diagram of the gaming machine of FIG. 1.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
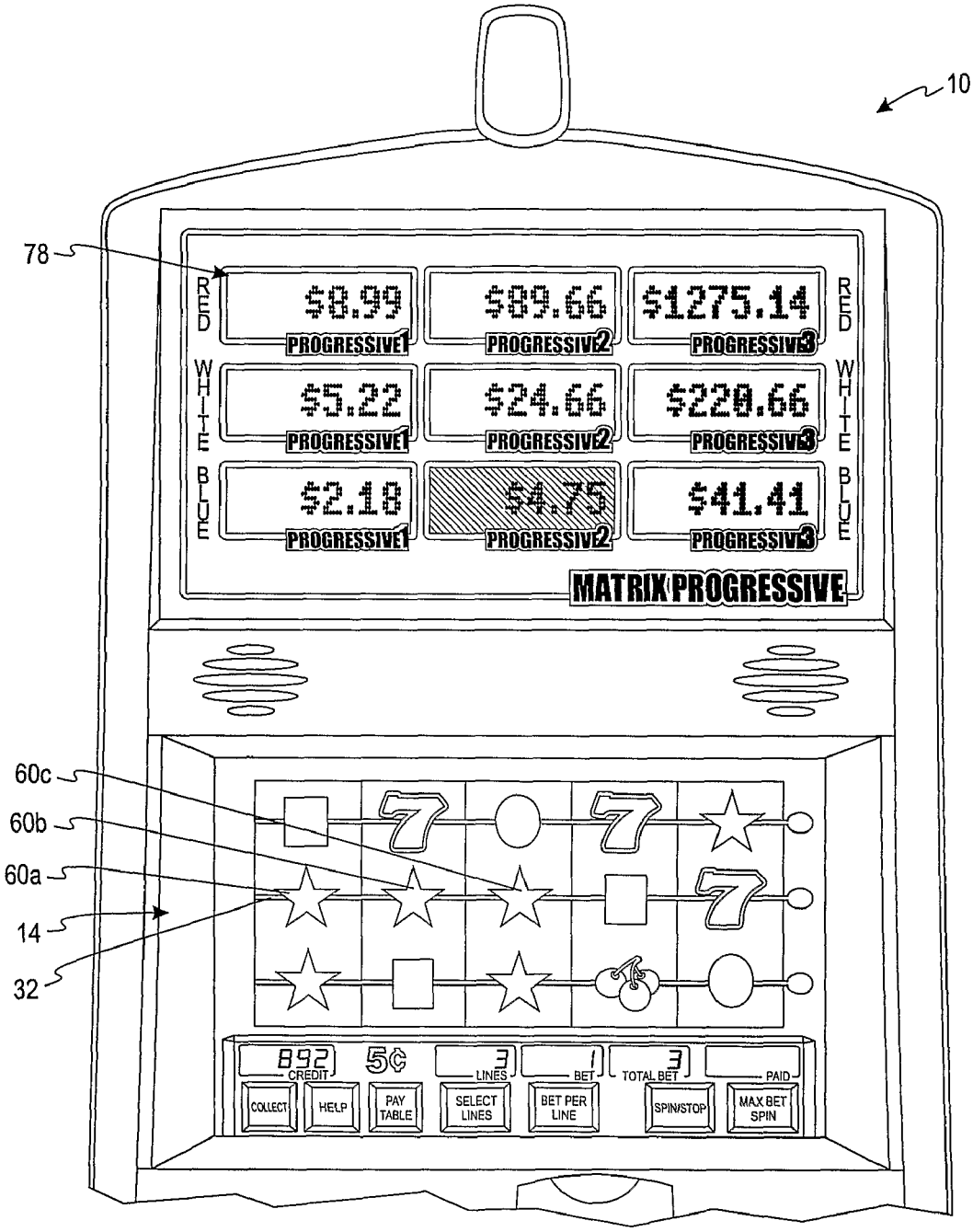
FIG. 3 illustrates a display of a basic game on the gaming machine of FIG. 1, which triggers the award of one or more progressive jackpots.

Turning now to FIG. 3, the primary display 14 of the gaming machine 10 includes a plurality of video reels that simulate the movement of traditional mechanical reels in a slot-type wagering game. As shown, the video reels have resulted in three "star" symbols 60*a*, 60*b*, 60*c* being aligned along the middle payline 32. In this embodiment, the three "star" symbols 60*a*, 60*b*, 60*c* indicate the randomly selected outcome for the wagering game at the gaming machine 10 is a progressive-jackpot winning outcome. A progressive-jackpot winning outcome results in an award to the player of one or more of a plurality of progressive jackpots that are shown in a progressive game matrix 78 on the secondary display 16.

As show in FIG. 3, the progressive game matrix 78 includes nine different progressive jackpots for which the player is eligible. The progressive jackpots are indicated by rows of colors (RED, WHITE, BLUE) and columns of numbers (PROGRESSIVE1, PROGRESSIVE2, and PROGRESSIVE3). When achieving a progressive-jackpot winning outcome, the player can win one cell, one row, one column, selected cells within each row and/or column, or the entire matrix 78. In FIG. 3, the three "star" symbols 60*a*, 60*b*, 60*c* results in the player achieving the cell 80 defined by the BLUE row and PROGRESSIVE2 column (BLUE 2 jackpot), which pays $4.75 to the player.

The progressive game with the progressive jackpot matrix 78 in FIG. 3 can be operated in a stand-alone fashion. In other words, only wager amounts received at the gaming machine 10 result in contributions (typically a percentage of the wager amount or "coin-in") to one or more of the nine progressive jackpots in the matrix 78. However, in one preferred embodiment, the progressive game involves several linked gaming machines 10, such that the contributions (i.e., a percentage of coin-in) to the nine progressive jackpots in the matrix 78 are received from several gaming machines 10. The progressive game may be a bank-level progressive game that receives contributions from all of the gaming machines 10 in a particular bank. Alternatively, the progressive game may be a wide-area progressive game that receives contributions from a larger number of gaming machines 10, such as multiple banks, or gaming machines 10 in multiple casinos.

FIG. 4-9 illustrates the manner in which the progressive jackpots in the matrix 78 (FIG. 3) are increased. With respect to FIG. 4-9, it is assumed that the contributions to the progressive jackpots are received based on a known percentage (s) of coin-in from more than one linked gaming machine 10. While the progressive jackpots in the matrix 78 (FIG. 3) as a group may be funded by a set percentage of the total coin-in, which progressive jackpot receives which portions are dictated by the distribution sets listed in the tables of FIGS. 4-9. As such, the nine progressive jackpots are set at their various starting levels (i.e., base levels) and as players play the wagering games at one or more of the gaming machines 10, a set percentage of the coin-in is allocated to the progressive jackpots in accordance with the distribution set that is being utilized at that time. The instructions corresponding to the distribution sets are stored in a memory device 36 (FIG. 2) within one or more gaming machines 10 or a memory device outside the gaming machine 10 in a progressive network. The instructions are executed by either the local controller 34 (FIG. 2) or a processor in the external system 50.

With respect to FIG. 4, a table 110 includes have a "set" column 112, a "contribution threshold" column 114, and "distribution percentage" columns 116 that dictate the distribution of the progressive funds to the nine progressive jackpots in the matrix 78 (FIG. 3). The final column in the distribution-percentage columns 116 simply indicates that 100% of the total coin-in for each of SETS 1-5 has been accounted for. In operation, as the linked gaming machines 10 receive coin-in, a portion of the coin-in is allocated to the progressive jackpots in accordance with the SET 1 in table 110 (i.e., 25% to each of the RED 1, RED 2, RED 3, and WHITE 1 jackpots in the progressive matrix 78 of FIG. 3). When the total contribution to those four progressive jackpots achieves the contribution threshold of $5 for SET 1, then the progressive jackpots are funded in accordance with the SET 2. As such, the next $10 of contributions to the progressive jackpots will be equally split (i.e., 50%) between two jackpots, the RED 2 and WHITE 1 jackpots. After the $10 of the contribution threshold for SET 2 is achieved, the progressive jackpots of the progressive matrix 78 of FIG. 3 are sequentially funded in accordance with the SET 3, SET 4, and SET 5. Once the $25 contribution threshold is achieved by the SET 5, the SET 1 begins to again dictate the contribution according to its distribution pattern. The SETS 1-5 are sequentially repeated to allocate the progressive funds to the jackpots. As can be seen, the group of progressive jackpots that receive progressive funds in one set can be mutually exclusive with the group of progressive jackpots that receive progressive funds in another set. And, the group of progressive jackpots that receive progressive funds in one set and the group of progressive jackpots that receive progressive funds in another set may share common jackpots.

Within each of the SETS 1-5, the manner in which each eligible progressive jackpot receives its distribution percentage can vary. For example, in the SET 1, each of the RED 1, RED 2, RED 3, and WHITE 1 jackpots can receive the same amount on substantially a simultaneous basis. Thus, as an example, for every $0.04 that is received from coin-in, the values of these four jackpots case increase by $0.01, as displayed on the secondary display 16 that shows the progressive matrix 78 in FIG. 3. Alternatively, each of the RED 1, RED 2, RED 3, and WHITE 1 jackpots can be paid in succession, such that the RED 1 jackpot gets the first $0.04 that is contributed from coin-in, and then RED 2 gets the next $0.04, and so on, until the $5 threshold of SET 1 has been distributed.

In a further alternative, the RED 1 jackpot may get its entire 25% of the contribution threshold 114 (i.e., $1.25) first, and the next 25% is allocated to the RED 2 jackpot, and so on. As yet another modification to this internal-set contribution methodology, after the first full sequential cycle through the SETS 1-5, the RED 2 jackpot can be the first to receive its entire 25% of the contribution threshold and the RED 1 jackpot is the last jackpot in SET 1 to receive its share. In the third contribution according to the SET 1 (i.e., after two full sequential cycles through the SETS 1-5), the RED 3 jackpot in SET 1 is the first to receive its 25% contribution first. These internal-set contribution methods may enhance the appearance of randomness for the progressive funding.

As can be appreciated, the distribution patterns in accordance to SETS 1-5 in table 110 (and within each SET 1-5) can provide the players with the illusion that the jackpots are being randomly funded. Considering that the distribution patterns of the SETS 1-5 are unknown to the players, from the player's perspective, there appears to be no detectable pattern, even though it is a repeating and predictable pattern such that the amount of funds being allocated to each of the nine progressive jackpots is well known. As such, the player gets the feeling of random allocations to the progressive jackpots, yet there is no need for a separate random-number generator to dictate a random distribution to the nine jackpots. Further, from the gaming establishment's perspective, reconciling the progressive awards and jackpots is easier as well when using these distribution sets.

If one of the players at the gaming machines 10 achieves a progressive winning outcome, then the associated jackpot(s) is awarded to the player and the base amount for that jackpot is reestablished. That jackpot is then funded again the next time one of the SETS 1-5 that allocates funds to it is utilized. The progressive winning outcome may be dictated by a symbol combination in the basic wagering game, as shown in FIG. 3. Or, a symbol combination may allow the player to play a distinct progressive-wagering game, whereby the player has a chance to win one or more of the plurality of progressive jackpots displayed in the progressive jackpot matrix 78.

FIG. 5 illustrates an alternative embodiment with a table 210 that includes have a "set" column 212, a "contribution threshold" column 214, and "distribution percentage" columns 216 that dictate the distribution to the nine progressive jackpots in the matrix 78 (FIG. 3). The final column in the distribution-percentage columns 216 indicates that 100% of the funds has been distributed.

Unlike FIG. 4, the contribution threshold 214 in FIG. 5 is much lower, yielding a plurality of sets (SET 1 to SET "N") that, relative to the Table in FIG. 4, advance quickly through each cycle due to the contribution thresholds being lower. In the same manner described with respect to FIG. 4, each set dictates the distribution of a certain amount of coin-in. For example, the first $0.20 in progressive jackpot amounts is distributed according to the SET 1 with 25% ($0.05) going to each of the RED 1, RED 2, RED 3, and WHITE 1 jackpots. Because the amounts are lower, it may be desirable to have many sets (perhaps several hundred or several thousand) through which the progressive funding system cycles. From the players' perspective, the funding would appear random and it would be nearly impossible, if not impossible, for a player to identify a pattern by which the progressive jackpots increase in the matrix 78.

In a further alternative, for each repeating cycle, the SET 1 to SET "N" sequential utilization for funding would not occur in the same numerical order. As an example, in FIG. 5, the SET 1 to SET "N" may be used in the first cycle through all of the sets in the set column 212. But, in the second cycle, the sets may be used in reverse order, with SET "N" being the first used and SET 1 being the last used. In the third cycle using all the sets in the set column 212, the odd set numbers may be used first and the even set numbers may be used last. Obviously, several other non-numerical-order arrangements can be used to sequentially utilize all the sets within the table 210.

FIGS. 6 and 7 illustrate a pair of tables 310 and 410, respectively, that describe how certain changes in the contribution threshold can affect the funding for certain ones of the progressive jackpots in the matrix 78. In FIG. 6, the sum of each column in the distribution columns 316 is 100%. Because the threshold contribution column for each set, (i.e., SET 1 to SET 9) is identical ($10), for each cycle through all nine sets, each of the nine progressive jackpots would receive the identical amount.

In FIG. 7, the threshold contribution column 414 has been slightly altered such that the SET 2 and SET 8 each have contribution thresholds of $20, as opposed to the $10 setting in FIG. 7. This alteration causes certain ones of the progressive jackpots (here, the RED 2, RED 3, WHITE 3, and BLUE 3 jackpots) to receive additional funding relative to the other progressive jackpots. Accordingly, in addition to the distribution percentage columns 416 having different percentages to provide additional funding to one or more of the progressive jackpots, manipulation of the contribution threshold column 414 can also achieve this result as well.

Furthermore, it should be appreciated that the present invention contemplates the real-time manipulation of the distribution percentage columns 416 and/or contribution threshold column 414 to achieve a different funding scheme, thereby providing additional funding to one or more of the progressive jackpots. As just one example, if the progressive gaming system determines that one progressive jackpot has exceeded a certain limit without being won by a player, to create additional excitement for the players, that progressive jackpot can begin to increase at a faster pace by manipulation of the contribution threshold column 414 or distribution percentage columns 416. When this occurs, one or more of the other progressive jackpots will have their contributions levels decreased by an amount corresponding to the increase so that the overall progressive payout to all players remains the same.

FIG. 8 illustrates a variation in the overall contribution methodology, resulting in more randomly distributed amounts. Unlike the previous examples, each contribution threshold column 514 has a variable "X" assigned to each set. As one example, there may be nine possible contribution thresholds and a corresponding one of these nine contributions thresholds is assigned to each of the variables X1 to X9 for each cycle through the nine sets. Or, a range of possible contribution thresholds (e.g., between $1 and $20) can be used and nine values within the range (e.g., $1, $4.50, $2, $19, $12, $3, $8, $14.50, $6) is randomly chosen for X1 to X9.

Thus far, FIGS. 4-8 have described a certain format for a table where the contribution threshold column 114, 214, 314, 414, 514 has a value that is allocated according to the distribution percentage columns 116, 216, 316, 416, 516. However, other types of formatted sets can achieve the same result. As one example, in FIG. 9, the contribution threshold column has been replaced with a coin-in threshold column 614. And, the percentages in the percentage distribution columns 616 is an absolute percentage of the total coin-in that is allocated to each progressive jackpot for each set in the set column 612. As an example, in accordance with SET 1, the first $5 of coin-in for the progressive game (received by one or more of the gaming machines 10) results in a contribution of $0.025 ($5 times 0.5%) for the RED 1 jackpot and a contribution of $0.05 ($5 times 1.0%) for the RED 2 jackpot. The percentage of the total coin-in for the progressive game, as listed in the last column of percentage distribution column 616, is 1.5%. After SET 1 has been fulfilled, the distribution in accordance with SET 2 begins, followed by SET 3, and so on. Again, FIG. 9 illustrates another example of the ways to format a distribution table whereby the actual contributions to each progressive are known, but it appears to the players to be in a randomly assigned order.

The distribution table, like the ones in FIGS. 4-9, can be stored in a memory device 36 (FIG. 2) within each gaming machine 10, especially in the case where the distribution table is directed to a local progressive game being only played on that gaming machine 10. Further, in such a case, the distribution tables can be periodically updated by downloading new tables from a central network (e.g., a progressive gaming network). For progressive games involving several gaming machines 10, the allocation of funds is typically performed by a progressive control system on a dedicated network. In this case, the distribution tables, like the ones in FIGS. 4-9, can be stored in a memory device associated with the progressive network.

While the present invention has been described as having a single distribution table for each progressive game, multiple distribution tables could be employed at different times for the same progressive game. Each table would have a known distribution pattern and could be employed, for example, at different time intervals (e.g., every day, or every week).

Although the present invention has been described by showing the plurality of progressive jackpots in the form of a matrix, the invention can be used with any type of progressive game system having multiple jackpots. As one example, there are different systems for determining a progressive jackpot-won event at a gaming terminal. The first type gaming-machine enabled, which occurs when a "progressive winning position" (i.e., a progressive jackpot winning outcome) is achieved at a participating gaming machine. A progressive-winning position is a module within a gaming machine's software code that responds with a progressive-jackpot-won event when certain game-level conditions are met, such as a winning reel position on a slot machine. Only one progressive game may be assigned to a progressive winning position at a time. This position has a single winning percentage. At the time the progressive-winning position occurs at a gaming machine, the winning gaming machine is disabled from play and immediately transmits the jackpot-won event to the central system, such as external system 50 (FIG. 2). The central system calculates a final prize amount and transmits this amount to the winning gaming machine and to the other gaming terminals competing for the same progressive. The second type of jackpot-won event is central-system enabled. A progressive winning position is not used to generate a jackpot-won event when a progressive game awards a jackpot using a central-system-enabled jackpot-won event. An example may be a message sent from the central system to the gaming machine that places a wager that corresponds to a predetermined wager number (or amount) that triggers the progressive jackpot-won event. A central system-enabled jackpot-won event may, for example, be used in a mystery progressive system.

Further, it should be noted that the present invention has been described with respect to a basic game that triggers the crediting (i.e., funding) of the progressive jackpots in response to wager input. However, a progressive game could also be funded from a gaming machines 10 in response to certain symbols or symbol combinations being achieved in the basic game. Thus, the "coin-in" for funding the progressive jackpots occurs only after (i) a player makes a wager input and (ii) a certain symbol combination is achieved.

In addition to a single distribution table being used for one progressive game that is accessible at a gaining machine 10, multiple distribution tables can be used for multiple progressive games, where each progressive game has multiple jackpots for which a player is eligible. In other words, the player may be eligible for wide-area progressive jackpots, involving several casinos and a portion of his or her wager may be allocated in accordance with a wide-area progressive distribution table. Additionally, the player may be eligible for a bank-level progressive jackpots involving five or six gaming machines 10 adjacent to each other, and another portion of his or her wager may be allocated to the bark-level progressive jackpots in accordance with a bank-level progressive distribution table. Similarly, a local-area progressive dedicated to only a single gaming machine 10 may have its own progressive-jackpot distribution table.

These additional progressive games may require the player to place an additional wager to be eligible, which requires that the contribution amount (as used in the contribution threshold column 114, 214, 314, 414, 514, 614) be based on the additional wager that is used for incrementing the progressive jackpots, as opposed to total coin-in data. As one example, if the gaming machine 10 has multiple paylines 32 (FIG. 3), the first coin for each active payline may be counted towards the local-area progressive games and a portion on total-coin-in is distributed in accordance with a wide-area progressive distribution table. In addition, the player may be eligible for a plurality of local gaming-machine progressive jackpots that require funding based on a side-wager, which is then allocated to a plurality of jackpots available only on that gaming machine in accordance to a second distribution table.

Another method for specifying the progressive jackpot distribution described in the previous paragraph is for a controller to have a distribution table with different types of wager inputs for each progressive jackpot. For example, FIG. 10 shows such a distribution table 710, which includes have a "set" column 712, a "contribution threshold" column 714, and "distribution percentage" columns 716 that dictate the distribution of two fund types to the nine progressive jackpots in the matrix 78 (FIG. 3), and a Wide-Area-Progressive (WAP) jackpot, pursuant to column 716*a*. Within each set 712, there are two different types of wager inputs and their respective percentages for each progressive jackpot. First, the life-to-date (LTD) coin-in is the total wager amount from all of the gaming machines that are linked together. And second, the theme-specific progressive (TSP) is the amount of coin-in that the gaming machine passes to the progressive controller based on the rules for that specific game (it should be noted that several different types of gaming machines can be linked to one progressive jackpot). The TSP can be an extra wager, a sub-set of the player's wager, or any other amount that is appropriate for that game. Both of the TSP and LTD amounts are communicated to the progressive controller when a player places a wager. These are examples of two types of wager-input categories where a percentage of each category is distributed according to the sets 712 within the distribution table 710. Others types could be used as well.

In summary, the present invention also contemplates that progressive jackpots may be incremented based on a value that is a subset of the total coin-in, rather than the total coin-in. As such, the progressive wagering system may collect wager-input data and separate that wager-input data into two data fields, one on total coin-in and one for a subset of the total coin-in. Each of these data fields would independently affect how its associated progressive jackpot is funded. The rules that indicate how this subset in the second field is calculated would be dictated by the wagering game providing access to the progressive game.

While the present invention has been described with reference to one or more particular embodiments, those skilled in the art will recognize that many changes may be made thereto without departing from the spirit and scope of the present invention. For example, in embodiments illustrated in FIGS. 1-3, the main display 14 was a video display. It should be understood that the display 26 could also be mechanical reels. Also, progressive jackpots are often displayed on signage that is located proximate to (usually above) the gaming machines 10, which can also be done in accordance to the present invention. Each of these embodiments and obvious variations thereof is contemplated as falling within the spirit and scope of the claimed invention, which is set forth in the following claims.

What is claimed is:

1. A method for playing a wagering game on a gaming machine at which players are eligible for a progressive game having a plurality of progressive jackpots, the method comprising:

storing, in a memory device, a plurality of distribution sets for funding said plurality of progressive jackpots, each distribution set defining a percentage of funds to be distributed to each of said plurality of progressive jackpots, said plurality of distribution sets includes at least a first distribution set having percentages for funding said plurality of progressive jackpots that are different from percentages for other ones of said plurality of distribution sets;

receiving wagers from said players via at least one input device on said gaming machine;

in response to receiving said wagers from said players, conducting wagering games in which said players are eligible for one or more of said plurality of progressive jackpots; and funding, by use of at least one of one or more processors, said plurality of progressive jackpots by a funding amount in accordance with said plurality of distribution sets, said funding amount being from a portion of said wagers, and wherein said funding includes utilizing said plurality of distribution sets separately and in a sequential order such that utilizing said first distribution set precedes utilizing said other ones of said plurality of distribution sets.

2. The method of claim 1, wherein said funding includes switching between said first distribution set and a second distribution set in said sequential order in response to a threshold associated with said first distribution set being met, said threshold being an amount related to a total coin-in for said progressive game.

3. The method of claim 2, wherein said threshold for said first distribution set is different from a threshold for said other ones of said plurality of distribution sets.

4. The method of claim 1, wherein at least one of said plurality of distribution sets includes a percentage of funds to be distributed to at least one of said plurality of progressive jackpots that is 0%.

5. The method of claim 1, wherein said funding is conducted in a manner to increase at least one of said plurality of progressive jackpots at a higher rate than other ones of said plurality of progressive jackpots.

6. The method of claim 1, wherein said memory device is located external to said gaming machine.

7. The method of claim 1, wherein said wagering game has a randomly selected outcome selected from a plurality of outcomes, said plurality of outcomes including a plurality of progressive-winning outcomes, each of said plurality of progressive-winning outcomes awarding one or more of said plurality of progressive jackpots.

8. The method of claim 1, wherein each of said plurality of distribution sets includes a percentage of total coin-in for said progressive game to be allocated to each of said plurality of progressive jackpots.

9. The method of claim 1, further including displaying, on at least one display device, values of said plurality of progressive jackpots.

10. The method of claim 9, wherein said displayed values of said plurality of progressive jackpots are increased in a manner consistent with funding provided by said plurality of distribution sets.

11. A gaming system for playing a progressive game have a plurality of progressive jackpots, comprising:

a first gaming machine having a first wagering game with a plurality of symbols that indicate a randomly selected outcome of said wagering game, said first gaming machine allowing a player to be eligible for said plurality of progressive jackpots;

a second gaming machine having a second wagering game with a plurality of symbols that indicate a randomly selected outcome of said second wagering game, said second gaming machine allowing a player to be eligible for said plurality of progressive jackpots; and a controller coupled to said first and second gaming machines and operative to allocate progressive funds from at least said first and second gaming machines to said plurality of progressive jackpots in accordance with a plurality of distribution sets, each of said distribution sets defining a percentage of funds to be distributed to each of said plurality of progressive jackpots, at least one of said plurality of progressive jackpots being allocated a first percentage by a first one of said plurality of distribution sets used during a first time period and a second percentage by a second one of said plurality of distribution sets used during a second time period that occurs after said first time period, said first percentage being different from said second percentage.

12. The system of claim 11, wherein said controller is further operative to, in response to said randomly selected outcome at said first gaming machine being a progressive-jackpot winning outcome, award said player one or more of said plurality of progressive jackpots.

13. The system of claim 11, wherein said plurality of distribution sets are stored in a memory device coupled to said controller.

14. The system of claim 11, wherein said controller is further operative to utilize said plurality of distribution sets in a sequential order.

15. The system of claim 14, wherein said controller switches between said plurality of distribution sets in response to a certain threshold value of total coin-in for said progressive game being achieved.

16. The system of claim 15, wherein said certain threshold value is different for different ones of said plurality of distribution sets.

17. The system of claim 11, wherein at least one of said plurality of progressive jackpots receives (i) 0% of said funds as dictated by some of said plurality of distribution sets and (ii) a higher percentage of said funds as dictated by others of said plurality of distribution sets.

18. The system of claim 11, wherein said controller is located external to said first and second gaming machines.

19. The system of claim 11, wherein said plurality of distribution sets results in different amounts being allocated to different ones of said plurality of progressive jackpots.

20. The system of claim 11, further including a display for displaying values of said plurality of progressive jackpots.

21. The system of claim 20, wherein said displayed values of said plurality of progressive jackpots are increased in a manner consistent with funding provided by said plurality of distribution sets.

22. A method of operating a progressive game that is accessible at a plurality of gaming machines, said progressive game having a plurality of progressive jackpots, said method comprising:

collecting first wager-input data at said plurality of gaming machines that corresponds to first wager inputs made at said plurality of gaming machines, said first wager inputs at said plurality of gaming machines allowing players to be eligible for said plurality of progressive jackpots;

crediting, by use of at least one of one or more processors, a portion of said first wager inputs to a first group of said plurality of progressive jackpots in accordance with a first distribution set;

in response to said first wager-input data meeting a predetermined criteria, crediting, by use of said at least one of one or more processors, a portion of second wager inputs occurring after said first wager inputs to a second group of said plurality of progressive jackpots in accordance with a second distribution set;

wherein at least one progressive jackpot receiving a first percentage of said first wager inputs from said first distribution set and a second percentage of said second wager inputs from said second distribution set, said first percentage being different from said second percentage; and wherein said first and second distribution sets define a percentages said first and second wager inputs to be distributed to each of said plurality of progressive jackpots.

23. The method of claim 22, further including in response to second wager-input data meeting another predetermined criteria while directing said portion of said second wager inputs in accordance to said second distribution set, crediting a portion of third wager inputs occurring after said second wager inputs to a third group of said plurality of progressive jackpots in accordance with a third distribution set; and wherein said at least one progressive jackpot receiving a third percentage of said third wager inputs from said third distribution set, said third percentage being different from said first and second percentages.

24. The method of claim 22, wherein said first and second groups are mutually exclusive.

25. The method of claim 22, wherein said first and second groups are different but both include a common one of said plurality of progressive jackpots.

26. The method of claim 25, wherein said common one receives an amount in accordance with said first distribution set that is different from an amount received in accordance with said second distribution set.

27. The method of claim 22, wherein said predetermined criteria is a total-coin value of said wager inputs being a predetermined value.

28. The method of claim 22, further including displaying, on at least one display device, values of said plurality of progressive jackpots.

29. The method of claim 28, wherein said displayed values of said plurality of progressive jackpots are increased in a manner consistent with funding provided by said plurality of distribution sets.

30. A method for operating a progressive game having a plurality of progressive jackpots, the method comprising:

aggregating, by use of at least one of one or more processors, progressive-jackpot funds from a plurality of gaming machines at which said progressive game is accessible; and increasing, by use of said at least one of one or more processors, said plurality of progressive jackpots with said progressive-jackpot funds in accordance with a plurality of distribution sets for funding said plurality of progressive jackpots, each distribution set defining an amount to be distributed to each of said plurality of progressive jackpots, at least one of said plurality of progressive jackpots being allocated a first amount by a first one of said plurality of distribution sets and a second amount by a second one of said plurality of distribution sets, said first amount being different from said second amount, said increasing includes separately and sequentially switching between or among said plurality of distribution sets such that utilizing said first one of said distribution sets precedes said second one of said plurality of distribution sets.

31. The method of claim 30, wherein said sequential switching occurs in response to said progressive-jackpot funds from said plurality of gaming machines exceeding predetermine values.

32. The method of claim 31, wherein said predetermined values are different when switching between different ones of said plurality of distribution sets.

33. The method of claim 30, further including displaying, on at least one display device, values of said plurality of progressive jackpots.

34. The method of claim 33, wherein said displayed values of said plurality of progressive jackpots are increased in a manner consistent with funding provided by said plurality of distribution sets.

* * * * *

UNITED STATES PATENT AND TRADEMARK OFFICE

CERTIFICATE OF CORRECTION

PATENT NO. : 8,342,956 B2
APPLICATION NO. : 11/919733
DATED : January 1, 2013
INVENTOR(S) : Peter R. Anderson It is certified that error appears in the above-identified patent and that said Letters Patent is hereby corrected as shown below:

In the Claims

In column 14, line 64 (claim 22), after “define” please delete “a”.

In column 14, line 65 (claim 22), after “percentages” please insert -- of --.

Signed and Sealed this
Sixteenth Day of April, 2013

Teresa Stanek Rea
*Acting Director of the United States Patent and Trademark Office*